US008421690B2

(12) United States Patent
Cummings

(10) Patent No.: US 8,421,690 B2
(45) Date of Patent: Apr. 16, 2013

(54) ANTENNA HEATING APPARATUS

(76) Inventor: Michael Cummings, Glenrothes (GB)

( * ) Notice: Subject to any disclaimer, the term of this patent is extended or adjusted under 35 U.S.C. 154(b) by 362 days.

(21) Appl. No.: 12/814,514

(22) Filed: Jun. 14, 2010

(65) Prior Publication Data

US 2011/0298675 A1 Dec. 8, 2011

(30) Foreign Application Priority Data

Jun. 8, 2010 (GB) ..... 1009545.3

(51) Int. Cl.
*H01Q 1/02* (2006.01)

(52) U.S. Cl.
USPC ..... 343/704; 343/840; 343/872

(58) Field of Classification Search ..... 343/704, 343/840, 872, 912
See application file for complete search history.

(56) References Cited

U.S. PATENT DOCUMENTS 5,617,107 A * 4/1997 Fleming ..... 343/704
5,798,735 A * 8/1998 Walton, Jr. ..... 343/704
6,191,753 B1 2/2001 Ellis et al.
6,208,314 B1 3/2001 Bourquin
7,508,351 B2 * 3/2009 Greenleaf et al. ..... 343/872
2006/0250313 A1 11/2006 Greenleaf et al.

FOREIGN PATENT DOCUMENTS

| | | |
|---|---|---|
| JP | 59207701 | 11/1984 |
| JP | 61129903 | 6/1986 |
| JP | 02109402 | 4/1990 |
| WO | 88/07268 | 9/1988 |
| WO | 97/11505 | 3/1997 |

OTHER PUBLICATIONS

UK Search Report of patent application No. GB1009545.3.

* cited by examiner

*Primary Examiner* — Don Le

(57) ABSTRACT

Antenna heating apparatus includes a cover element adapted for covering a signal receiving surface of an antenna, and a heating element on the cover element. The cover element has a body portion which is shaped differently to that of the signal receiving surface of the antenna. The differently shaped body portion 16, preferably having a rear surface which is planar or concave so as to be spaced from the signal receiving surface of the antenna, in use defines at least in part a plenum chamber for heated air between the body portion and the signal receiving surface of the antenna. A method of preventing or limiting accumulation of precipitation on an antenna by use of such antenna heating apparatus is also provided.

20 Claims, 2 Drawing Sheets

ANTENNA HEATING APPARATUS

FIELD OF PATENT APPLICATION

The present patent application relates to antenna heating apparatus and to a method of using such apparatus to prevent or limit accumulation of precipitation on an antenna, more particularly but not necessarily exclusively being a parabolic antenna.

BACKGROUND

Antennas, typically being parabolic, for receiving satellite transmissions such as domestic television broadcast signals are now common and wide-spread. However, signal quality is impaired due to precipitation accumulating on the signal receiving surface of the dish. Often, such precipitation is snow, but hail and even rain do affect signal quality.

Similarly, the feed unit of an antenna is also subject to accumulation of precipitation which can adversely affect performance.

The present patent application seeks to provide a solution to these problems.

SUMMARY

According to a first aspect of the patent application, there is provided antenna heating apparatus including a cover element adapted for covering a signal receiving surface of an antenna, and a heating element on the cover element, the cover element having a body portion which is shaped differently to that of the signal receiving surface of the antenna to in use define at least in part a plenum chamber for heated air between the body portion and the signal receiving surface of the antenna.

According to a second aspect of the patent application, there is provided a method of preventing or limiting accumulation of precipitation on an antenna by use of antenna heating apparatus, the method including the steps of: a) mounting a cover element to an antenna whereby a plenum chamber is formed at least between a signal receiving surface of the antenna and a rear surface of a body portion of the cover element which is shaped differently to that of the signal receiving surface of the antenna; and b) energising a heating element on the cover element to heat air in the plenum chamber whereby precipitation on the body portion of the cover element is reduced or removed.

According to a third aspect of the patent application, there is provided antenna apparatus comprising an antenna having a signal receiving surface, a cover element which covers the signal receiving surface of the antenna, and a heating element on the cover element, the cover element having a body portion which has a rear surface shaped differently to that of the signal receiving surface of the antenna so as to be spaced from the signal receiving surface whereby a plenum chamber is defined between the body portion and the signal receiving surface of the antenna to hold air heated by the heating element.

The patent application will now be more particularly described, by way of example only, with reference to the accompanying drawings.

DETAILED DESCRIPTION

Figure 1:
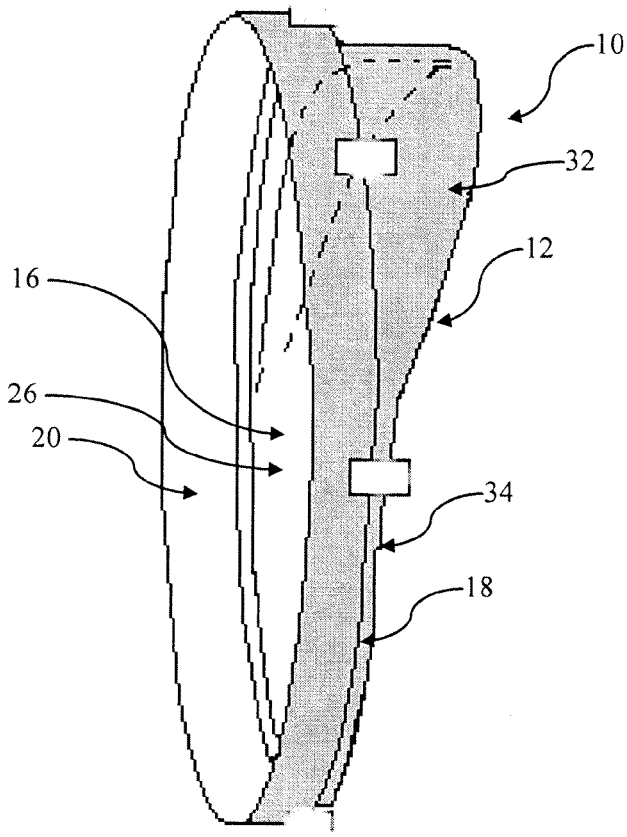
FIG. 1 shows a rear perspective view of one embodiment of antenna heating apparatus, in accordance with the first aspect of the patent application.
Figure 2:
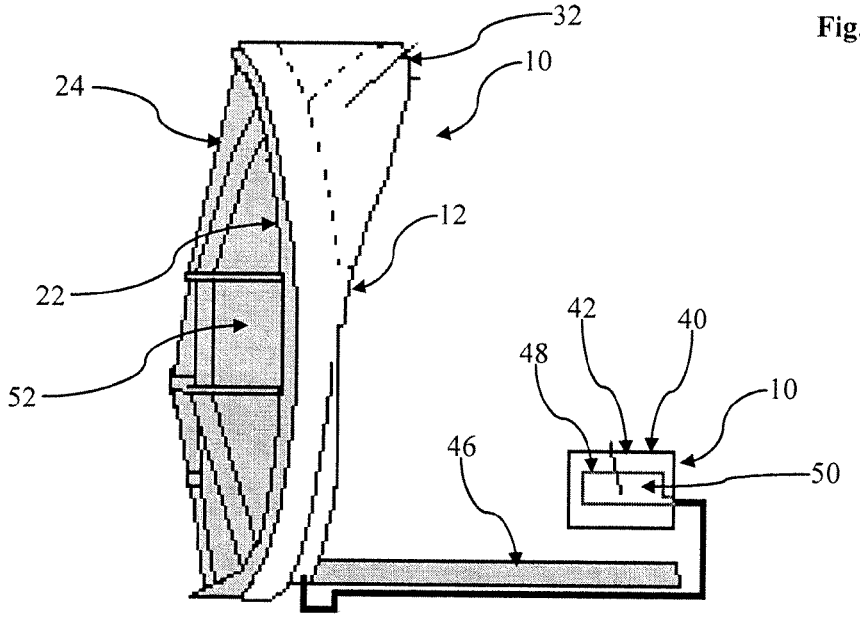
FIG. 2 shows a side elevational view of the antenna heating apparatus, in use and attached to an antenna thus forming antenna apparatus.
Figure 3:
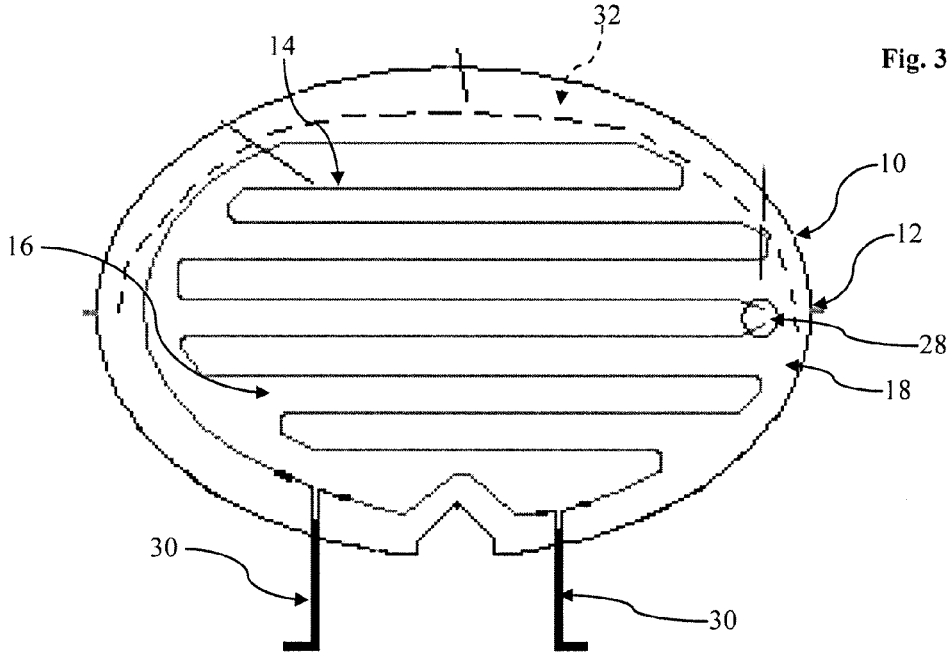
FIG. 3 shows a rear view of the antenna heating apparatus as shown in FIG. 2.
Figure 4:
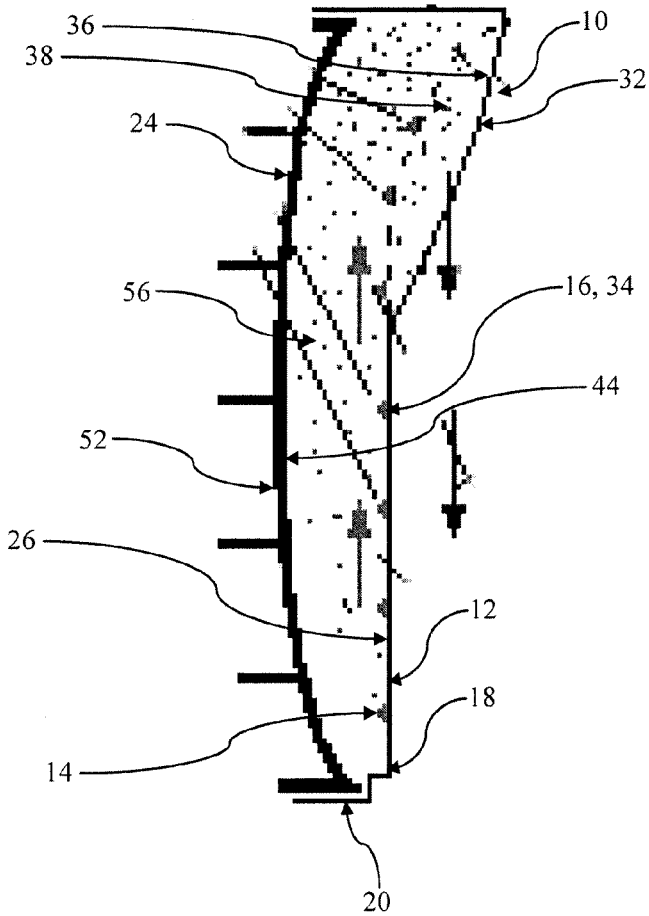
FIG. 4 is a diagrammatic side cross-sectional view, similar to FIG. 2, and showing a plenum chamber and air flow movement.

Referring to the drawings, there is shown antenna heating apparatus 10 which comprises a cover element 12 and a heating element 14 which is provided on the cover element 12. The cover element 12 is preferably one-piece moulded plastics, and may conveniently be vacuum formed from UV stable or resistant ABS. As such, the cover element 12 is semi-rigid with some flex to enable mounting.

The cover element 12 includes a body portion 16 which extends substantially to the perimeter edge 18 of the cover element 12, and a continuous or substantially continuous perimeter skirt 20 which extends rearwardly of the body portion 16 from the perimeter edge 18. An in-turned edge which extends from the skirt 20 may also be provided for location over a rear perimeter edge 22 of an antenna 24. This would be beneficial to combat more extreme weather such as driving rain working its way under the cover element 12 and thus potentially causing corrosion issues for the antenna 24.

The body portion 16 in this embodiment is planar or substantially planar. However, in a modification, at least the rear surface 26 of the body portion 16 may be or include a concave portion.

From the front, the cover element 12 is oval or substantially oval. However, other shapes to accommodate any shape of antenna 24 can be provided.

The heating element 14 is, in this case, a heating wire which is preferably PTFE insulated. The heating element 14 is attached to the rear surface 26 of the body portion 16 in a generally serpentine arrangement so that it extends across the whole or substantially whole of the body portion 16. Attachment is via adhesive tape or bonding. However, it is feasible to incorporate the heating element 14 within the body portion 16 during manufacture.

A thermostat unit 28 is included for controlling the heating element 14. In this case, the thermostat unit 28 is partway along the heating element 14 and is thus attached to the body portion 16. However, it is possible that the thermostat unit 28 could be provided so as to be spaced from the body portion 16. Other forms of controller are, additionally or alternatively, also feasible, such as a timer, hygrostat and so forth. Monitoring of snow conditions is also possible, for example, by incorporating a hygrostat or humidistat controller, so that the heating element can be controlled accordingly.

Conductor tails 30 of the heating element 14 extend away from the cover element 12 for connection to a mains power supply, and this may be via a suitable regulator and/or transformer.

The cover element 12 is also preferably provided along its upper edge 18 with a substantially rigid cowling 32 in the form of an extending or protruding lip which overhangs a front surface 34 of the body portion 16. The cowling 32 is integrally formed as one-piece, typically during moulding of the cover element 12. Conveniently, the cowling 32 is hollow, whereby its rear surface 36 which forms part of the rear surface 26 of the cover element 12 provides a supplementary plenum cavity 38 for receiving air heated by the heating element 14.

The cowling 32, in this embodiment, extends partway around the perimeter edge 18 of the cover element 12, substantially to the maximum diameter of the body portion 16 and thus substantially 180 degrees. However, the cowling 32 could extend further around the perimeter or for less distance dependent on necessity.

The antenna heating apparatus 10 may further comprise a feed cover 40 which is separate of the cover element 12 mentioned above. This is utilised for a feed unit 42 of the parabolic antenna 24 which is held facing the signal receiving surface 44 of the antenna 24 on a boom 46. The feed cover 40 preferably covers at least part of the feed unit 42, such as the top and side surfaces.

A supplementary heating element 48 is preferably provided on the feed cover 40, and this may be conveniently in series with the main heating element 14 described above. Beneficially, the thermostat unit 28 thus also controls the supplementary heating element 48. However, the supplementary heating element 48 may be separate of the main heating element 14 and may also include its own dedicated controller.

Furthermore, the feed cover 40 may also be adapted to least in part define a feed plenum chamber 50 between the feed cover 40 and the antenna feed unit 42 for receiving heated air, in a similar manner as the body portion 16 of the cover element 12. As such, the feed cover 40 may not be formed to be an entirely complementary fit with the feed unit 42, thereby in use providing at least in part the feed plenum chamber 50.

The feed cover 40 is preferably formed of UV stable or resistant plastics, similarly to the cover element 12.

In use, the cover element 12 with the heating element 14 pre-attached or integrally formed therein, is located on the parabolic dish 52 of the antenna 24 so as to cover the signal receiving surface 44. The skirt 20 extends as a close fit around the edge 22 of the dish 52. The skirt 20 is fastened to the edge 22 of the dish 52 using screw-threaded fasteners, such as screws, and/or sealant or adhesive. This prevents or limits the chance of dislodgement during harsh weather.

The planar or concave body portion 16 together with the signal receiving surface 44 of the antenna dish 52 forms plenum chamber 56. Due to the different shape of the rear surface of the body portion, the rear surface is spaced from the signal receiving surface and thus the plenum chamber 56 is formed. Once the heating element 14 is energised, the cover element 12 is heated initially preventing or limiting precipitation from accumulating. The air within the plenum chamber 56 is also heated. Once the thermostat unit 28 deenergises the heating element 14, the heated air within the plenum chamber 56 maintains the cover element 12 at a raised temperature. As such, substantially the whole of the cover element 12 is heated over a longer period using less energy. Precipitation, such as rain, sleet, snow, hail and ice, are prevented or inhibited from forming in the first place, and if accumulation does occur, then it is removed or at least significantly reduced during heating cycles.

The cowling 32 is also heated via the supplementary plenum cavity 38, and further acts to shield the front surface 34 of the body portion 16 which covers the signal receiving surface 44 from falling precipitation. Any precipitation which accumulates on the upper surface of the cowling 32 is removed or reduced by the heated air within the supplementary plenum cavity 38.

Due to the larger cavity volume nearer the top of the cover element in light of the cowling, rising heated air is retained thus heating the upper surface.

By the use of UV resistant material, the cover element 12 will also withstand the damaging effects of prolonged exposure to the sun.

The feed cover 40 with its supplementary heating element 48, once mounted on the feed unit 42, acts in a similar way as described above.

The front surface 34 of the body portion 16 of the cover element 12 may have the same geometry as the rear surface 26, being planar or convex, or it may have a different geometry. In any event, the front surface 34 of the body portion 16 conveniently provides a visual display area for advertising and artwork.

Although the cowling is hollow, it may be solid or separate. In this latter case, the cowling may be independently attachable to the cover element, and could therefore be removable.

Furthermore, the cowling may be dispensed with altogether, as necessity dictates.

The antenna heating apparatus can be provided as a kit of parts, and may be included as part of the antenna to form antenna apparatus, or may be provided separately as, for example, a retro-fit to an already installed antenna.

By the use of the plenum chamber, a raised temperature of the cover element is maintained even when the heating element is deactivated, thereby reducing electricity costs and preventing or limiting precipitation accumulation over a longer period. The cowling also shields the body portion against the elements, thereby also improving signal performance. The cover element itself also shields the antenna against damage and thus potentially costly repairs.

The embodiments described above are provided by way of examples only, and various other modifications will be apparent to persons skilled in the art without departing from the scope of the patent application as defined by the appended claims.

What is claimed is:

1. An Antenna heating apparatus comprising a cover element adapted for covering a signal receiving surface of an antenna, and a heating element on the cover element, the cover element comprising a body portion which is shaped differently to that of the signal receiving surface of the antenna and having a concave rear surface to in use define at least in part a plenum chamber for heated air between the body portion and the signal receiving surface of the antenna.

2. The antenna heating apparatus as claimed in claim 1, wherein the heating element is provided on the body portion.

3. The antenna heating apparatus as claimed in claim 2, wherein the heating element extends to or substantially to a perimeter of the body portion.

4. The antenna heating apparatus as claimed in claim 1, wherein the heating element is a heating wire.

5. The antenna heating apparatus as claimed in claim 1, wherein the cover element is at least semi-rigid.

6. The antenna heating apparatus as claimed in claim 1, wherein the cover element includes a cowling at least an upper portion of the body portion.

7. The antenna heating apparatus as claimed in claim 6, wherein the cowling defines a supplementary plenum cavity forming part of the plenum chamber.

8. The antenna heating apparatus as claimed in claim 6, wherein the cowling is integrally formed as one-piece with the body portion.

9. The antenna heating apparatus as claimed in claim 1, further comprising an antenna feed heating element for heating a feed unit of an antenna.

10. The antenna heating apparatus as claimed in claim 9, further comprising a feed cover for at least in part covering the antenna feed, the antenna feed heating element being provided on the feed cover.

11. The antenna heating apparatus as claimed in claim 10, wherein the feed cover is adapted to at least in part define a feed plenum chamber between the feed cover and the antenna feed unit for receiving heated air.

12. The antenna heating apparatus as claimed in claim 1, further comprising a thermostat unit for controlling the or each heating element.

13. A method of preventing or limiting accumulation of precipitation on an antenna by use of antenna heating apparatus, the method comprising the steps of: a) mounting a cover element to an antenna whereby a plenum chamber is formed at least between a signal receiving surface of the antenna and a rear surface of a body portion of the cover element which is shaped differently to that of the signal receiving surface of the antenna, wherein the body portion has a concave rear surface; and b) energising a heating element on the cover element to heat air in the plenum chamber whereby precipitation on the body portion of the cover element is reduced or removed.

14. The method as claimed in claim 13, wherein in step a) a feed cover is also provided on a feed unit of the antenna, and in step b) an antenna feed heating element on the feed cover is also energised to reduce or remove precipitation thereon.

15. The method as claimed in claim 14, wherein a feed plenum chamber is defined by the feed unit and the feed cover to accommodate air heated by the antenna feed heating element in step b).

16. The method as claimed in claim 13, wherein a rear surface of the body portion is one of planar and concave.

17. Antenna heating apparatus comprising a cover element adapted for covering a signal receiving surface of an antenna, and a heating element on the cover element, the cover element having a body portion which is shaped differently to that of the signal receiving surface of the antenna to in use define at least in part a plenum chamber for heated air between the body portion and the signal receiving surface of the antenna, and wherein the cover element includes a cowling at least an upper portion of the body portion.

18. Antenna heating apparatus as claimed in claim 17, wherein the cowling defines a supplementary plenum cavity forming part of the plenum chamber.

19. Antenna heating apparatus as claimed in claim 17, wherein the cowling is an overhanging lip.

20. Antenna heating apparatus as claimed in claim 17, wherein the cowling is integrally formed as one-piece with the body portion.

* * * * *